United States Patent [19]

Lu

[11] 4,397,934

[45] Aug. 9, 1983

[54] DEVELOPER COMPOSITIONS CONTAINING QUATERNIZED VINYLPYRIDINE POLYMERS, AND COPOLYMERS

[75] Inventor: Chin H. Lu, Webster, N.Y.

[73] Assignee: Xerox Corporation, Stamford, Conn.

[21] Appl. No.: 336,242

[22] Filed: Dec. 31, 1981

[51] Int. Cl.[3] ..... G03G 9/10; G03G 9/14

[52] U.S. Cl. ..... 430/110; 430/108

[58] Field of Search ..... 430/106, 108, 110

[56] References Cited

U.S. PATENT DOCUMENTS

| | | | |
|---|---|---|---|
| 3,893,935 | 7/1975 | Jadwin et al. | 252/62.1 |
| 3,944,493 | 3/1976 | Jadwin et al. | 252/62.1 P |
| 3,985,664 | 10/1976 | Sakaguchi et al. | 252/62.1 R |
| 4,079,014 | 3/1978 | Burness et al. | 252/62.1 |
| 4,221,856 | 9/1980 | Lu | 430/110 |
| 4,224,396 | 9/1980 | Pollet | 430/110 |
| 4,298,672 | 11/1981 | Lu | 430/108 |
| 4,299,898 | 11/1981 | Williams et al. | 430/106 |

FOREIGN PATENT DOCUMENTS 1536514 12/1978 United Kingdom .

*Primary Examiner*—John E. Kittle
*Assistant Examiner*—John L. Goodrow
*Attorney, Agent, or Firm*—E. O. Palazzo

[57] ABSTRACT

This invention relates to an electrostatic developer composition comprised of resin particles, pigment particles, carrier particles, and a charge enhancing component comprised of a partially quaternized vinylpyridinium polymer or copolymer selected from the group consisting of those materials of the following formula:

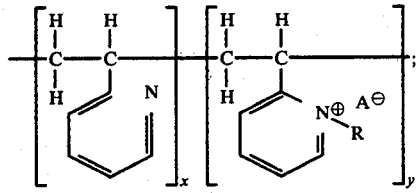

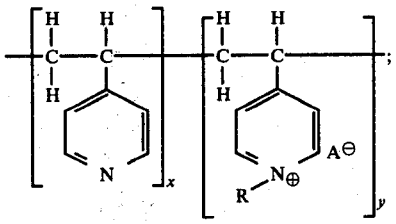

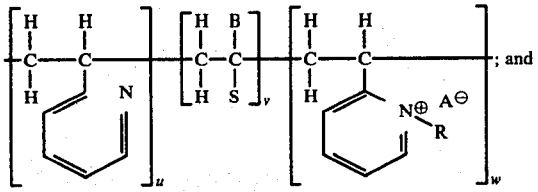

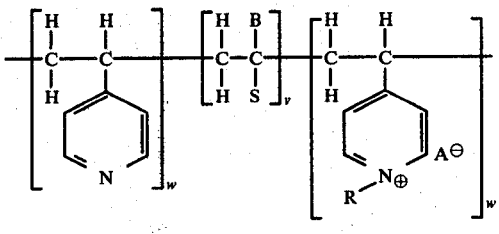

wherein R is an alkyl radical, A is an anion, B is an alkyl group or hydrogen, S is an acrylate, phenyl, halogen or cyano radical, x, y, u, v, w represent weight fraction numbers, subject to the provision that the sum of x and y is equal to 1, and the sum of u, v, and w is equal to 1, which compositions are useful in causing the development of images in electrostatographic imaging systems.

20 Claims, No Drawings

DEVELOPER COMPOSITIONS CONTAINING QUATERNIZED VINYLPYRIDINE POLYMERS, AND COPOLYMERS

BACKGROUND OF THE INVENTION

This invention is generally directed to developer compositions which can be utilized for the development of images in electrostatographic imaging systems. More specifically, the present invention is directed to developer compositions containing quaternized vinyl pyridine polymers, and copolymers, as charge enhancing components. The quaternized vinyl pyridine components of the present invention impart a positive charge to the toner particles, enabling such particles to be utilized for the development of negatively charged electrostatic latent images.

The electrostatographic process, and more specifically, the xerographic process is well known as documented in several prior art references. These processes involve the application of toner particles to the electrostatic latent image, for the purpose of causing development of such images. In some instances it may be desirable to produce a negative copy from a positive original, or a positive copy from a negative original, known as image reversal. In electrostatic imaging systems, image reversal can be accomplished by applying to the image a developer composition, containing toner particles and carrier particles, wherein the toner particles are repelled by the charged areas of the image, but adhere to the discharged areas. More specifically, toner particles possessing positive charges are very useful and effective in electrostatographic reversal systems, especially those employing organic photoreceptors, which in many instances are charged negatively. Reversal developers, which are comprised of electroscopic materials coated with finely divided colloidal silica are described for example, in U.S. Pat. No. 2,986,521.

Several prior art references disclose the use of charge control agents, such as specific quaternary ammonium compounds, which agents impart a positive charge to the toner particles. For example, in U.S. Pat. No. 3,893,935, there is disclosed the use of certain quaternary ammonium salts as charge control agents for electrostatic toner compositions. According to the disclosure of this patent, certain quaternary ammonium salts when incorporated into toner materials enabled the provision of a toner composition which exhibited relatively high uniform and stable net toner charge, when mixed with a suitable carrier material. U.S. Pat. No. 4,079,014 contains a similar teaching, with the exception that a different charge control agent is used, namely a diazo type compound.

Many of the above described toners and developers have a tendency over a period of time to lose their positive charge. Also some instances the charge control additives employed are incompatible with the thermoplastic toner resin, thus causing difficulties in obtaining a uniform dispersion of such additives in the toner resin. Further as some of the prior art charge control agents are not compatible with the toner resin, they adversely affect the electrical properties of the resin. Additionally, primarily because of their low molecular weight, such charge control agents have been known to leach out of the toner composition, and contaminate the carrier surface. Accordingly, thus there is a need for toner and developer compositions which can be used in a reversal system, and more specifically, there is a need for positively charged dry electrostatographic toner materials, which will enable the production of high quality images over extended periods of time.

SUMMARY OF THE INVENTION

It is a feature of this invention to provide a toner composition, and a developer composition, which overcomes the above-noted disadvantages.

It is a further feature of the present invention to provide a developer composition which contains positively charged toner particles, and carrier particles.

Another feature of this invention is the provision of a developer composition which contains positive charged toner particles, and certain charge enhancing components.

A further feature of the present invention is the provision of partially quaternized vinyl pyridinium polymers, and copolymers, as charge enhancing components.

Another feature of the present invention is to provide developer compositions useful for causing the development of negative electrostatic images, which compositions will transfer effectively, electrostatically to plain bond paper without causing blurring, or otherwise adversely affecting the quality of the resulting image.

These and other features objects of the present invention are accomplished by providing developer compositions comprised of resin particles, pigment particles, carrier particles, and a partially quaternized vinyl pyridinium polymer, including copolymers, selected from the group consisting of those materials as represented by the following formulas:

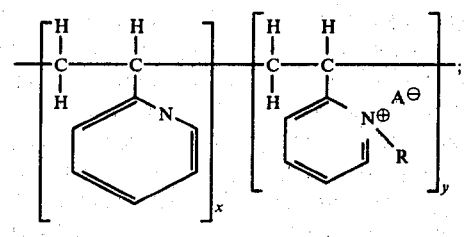

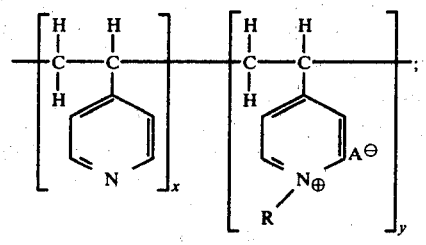

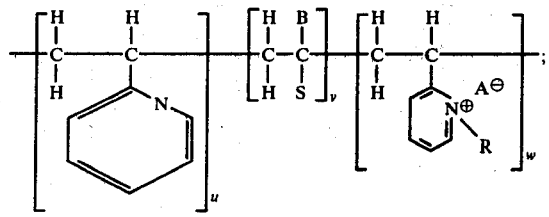

and

-continued

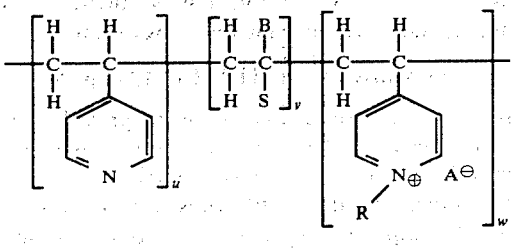

wherein R is an alkyl radical, A is an anion, B is an alkyl radical or hydrogen, S is an acrylate, phenyl, halogen, or cyano radical, x, y, u, v, and w represent weight fraction numbers, (weight of monomer divided by total weight of polymer) subject to the provision that x+y is equal to 1, and the sum of u+v+w is equal to 1. The symbol x can thus be a number of less than 1, for example x can be a number of from about 0.1 to about 0.9. When x is the number 0.9, y is the number 0.1. Similarly, the symbols u, v, and w can be numbers of from 0.1 to about 0.9, subject to the provision that the sum of these numbers is equal to 1.

Illustrative examples of alkyl radicals include those containing from 1 to about 20 carbon atoms, and preferably those containing from 1 to about 6 carbon atoms, such as methyl, ethyl, propyl, butyl, pentyl, octyl, nonyl, decyl, myristyl, cetyl, olely, and the like, with methyl, propyl, and butyl being preferred.

Illustrative examples of the anion A include halides, such as chloride, fluoride, bromide or iodide, sulfate, sulfonate, borate, nitrate and phosphate, with the anions chloride and bromide being preferred.

Illustrative examples of specific partially quaternized vinyl pyridinium polymers and copolymers embraced within the present invention include for example poly(2-vinyl pyridine) partially quaternized with butyl bromide, poly(4-vinyl pyridine) partially quaternized with butyl bromide, poly(2-vinyl pyridine/styrene) partially quaternized with isopropyl bromide, poly(4-vinyl pyridine/styrene) partially quaternized with butyl bromide, poly(4-vinyl pyridine) partially quaternaized with octyl chloride, poly(styrene/n-butyl methacryalte/4-vinyl pyridine), partially quaternized with n-butyl bromide, and the like.

Poly(4-vinyl pyridine) partially quaternized with n-butyl bromide can be represented by the following:

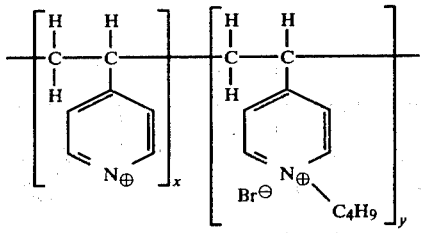

while the copolymers of 4-vinyl pyridine and styrene partially quaternized with n-butyl bromide can be represented by the following:

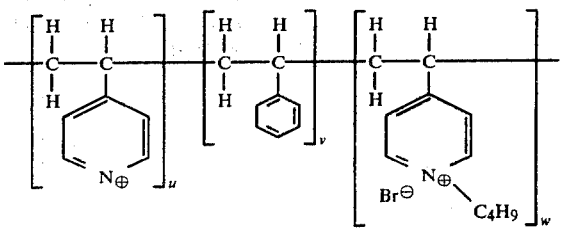

wherein the sum of x plus y is equal to 1, and the sum of u plus v, plus w is equal to 1.

The partially quaternized vinyl pyridinium polymers, and copolymers, of the present invention are added to the toner particles in an amount that does not adversely affect the properties of such particles, and that results in a toner that is charged positively, in comparison to the carrier. Thus, for example, the amount of quaternized vinyl pyridinium material present in the developer composition can vary from about 0.1 weight percent to about 98 weight percent, and preferably from about 1 weight percent to about 10 weight percent. The partially quaternized vinyl pyridinium materials can be blended into the developer mixture, or coated on a pigment, such as carbon black, which is used as a colorant in the developing composition. By developing composition is meant a composition comprised of toner particles, toner resin plus pigment, and carrier particles.

Various suitable resins may be employed in the toner composition of the present invention, including polyamides, epoxies, polyurethanes, vinyl resins and polyesters, especially those prepared from dicarboxylic acids and diols comprising diphenols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated monoolefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of aliphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred. The styrene resin employed may be a homopolymer of styrene or styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins, which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins, and mixtures thereof.

Also esterification products of a dicarboxylic acid, and a diol comprising a diphenol may be used as a preferred resin material for the toner composition of the present invention, as illustrated in U.S. Pat. No. 3,655,374, the disclosure of which is totally incorporated herein by reference.

Any suitable pigment or dye may be employed as the colorant for the toner particles, such materials being well known and including for example, carbon black, nigrosine dye, aniline blue, calco oil blue, chrome yellow, ultramarine blue, phthalocyanine blue and mixtures thereof. The pigment or dye should be present in the toner in sufficient quantity to render it highly colored, so that the toner will form a clearly visible image on the recording member. For example, where conventional xerographic copies of documents are desired, the toner may comprise a black pigment, such as carbon black. Preferably, the pigment is employed in amounts of from about 2 percent to about 20 percent by weight, based on the total weight of the toner particles, however, if the colorant employed is a dye, substantially smaller quantities may be used.

The toner resin is present in an amount so that the total of all ingredients used equal about 100 percent, thus when 5 percent by weight of the partially quaternized vinyl pyridine polymer is present, and 10 percent by weight of pigment or colorant such as carbon black, about 85 percent by weight of resin material is present.

Illustrative examples of carrier particles useful in the present invention, include those carrier particles which are capable of triboelectrically obtaining a charge of opposite polarity to that of the toner particles. In the present invention in one embodiment that would be a negative polarity, in order that the toner particles will adhere to and surround the carrier particles. Thus, the carrier particles can be selected so that the toner particles acquire a charge of a positive polarity, and include materials such as potassium chlorate, granular zircon, granular silicon, methylmethacrylate, glass, steel, nickel, iron ferrites, silicon dioxide and the like, with metallic carriers especially magnetic carriers being preferred. The carriers can be used with or without a coating. The coatings generally contain polyvinyl fluoride resins, but other resins especially those which charge negatively, such as polystyrene, halogen containing ethylenes and the like can be used. Many of the typical carriers that can be used are described in U.S. Pat. Nos. 2,618,441; 2,638,522; 3,618,522; 3,591,503; 3,533,835; and 3,526,533. Also nickel berry carriers as described in U.S. Pat. Nos. 3,847,604 and 3,767,598 can be employed, these carriers being nodular carrier beads of nickel characterized by surface of reoccurring recesses and protrusions providing particles with a relatively large external area. The diameter of the coated carrier particle is from about 50 to about 1,000 microns, thus allowing the carrier to possess sufficient density and inertia to avoid adherence to the electrostatic images during the development process.

The carrier may be employed with the toner composition in any suitable combination, however, best results are obtained when about 0.5 parts to about 10 parts of toner, to 100 to 200 parts by weight of carrier, and preferably about 1 part to 5 parts of toner, to 100 parts by weight of carrier.

Developer compositions of the present invention may be used to develop electrostatic latent images on various suitable electrostatic surfaces capable of retaining charge including conventional photoconductors, however, the toners of the present invention are best utilized in systems wherein a negative charge resides on the photoreceptor, and this usually occurs with organic photoreceptors. Examples of such photoreceptors include polyvinyl carbazole, 4-dimethylaminobenzylidene, benzhydrazide; 2-benzylidene-amino-carbazole, 4-dimethylamino-benzylidene, benzyhydrazide; 2-benzylidene-aminocarbazole, polyvinylcarbazole; (2-nitrobenzylidene)-p-bromoaniline; 2,4-diphenyl-quinazoline; 1,2,4-triazine; 1,5-diphenyl- 3-methyl pyrazoline 2-(4'-dimethyl-amino phenyl)-benzoxazole; 3-aminocarbazole; polyvinylcarbazole-tritrofluorenone charge transfer complex; phthalocyanines, overcoated photoreceptors containing charge transport and charge generating layers, and the like. Examples of charge generating layers include vanadyl phthalocyanine, and trigonal selenium, while examples of charge transport layers include certain diamines, such as N,N'-diphenyl-N-N' bis(3-methylphenyl)-[1,1'-biphenyl]-4,4'-diamine, dispersed in a polycarbonate resin, reference U.S. Pat. No. 4,251,612, the disclosure of which is totally incorporated herein by reference.

Numerous methods may be utilized to produce the toner composition of the present invention, one method involving melt blending the resin and the pigment with the partially quaternized vinyl pyridinium material, followed by mechanical attrition. Other methods include those well known in the art such as spray drying, melt dispersion, and dispersion polymerization. For example, a solvent dispersion of a resin pigment and a partially quaternized vinyl pyridinium polymer and copolymer are spray dryed under controlled conditions, thereby resulting in the desired product. A composition prepared in this manner results in a positively charged toner in relationship to the carrier materials, and these materials exhibit the improved properties as mentioned herein.

In another embodiment, the present invention is directed to a method of imaging comprising forming a negative electrostatic latent image on a photoresponsive device, contacting the image with a developer composition, comprised of resin particles, pigment particles, carrier particles, and a charge enhancing component comprised of partially quaternized vinylpyridinium polymers, including copolymers selected from the group consisting of those materials of the following formula:

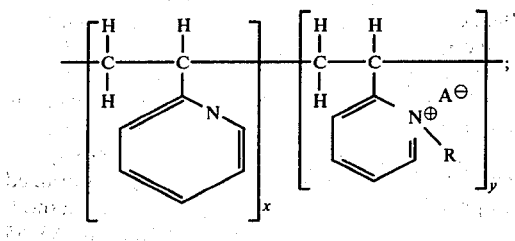

-continued

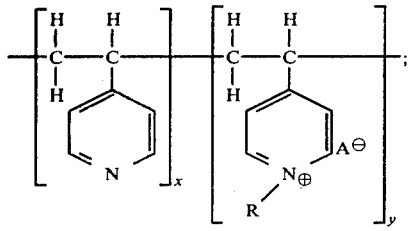

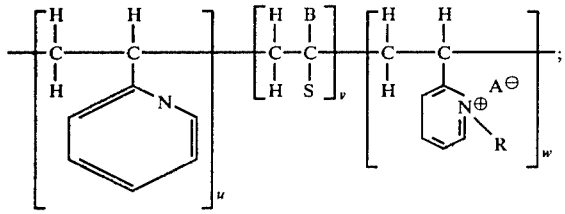

and

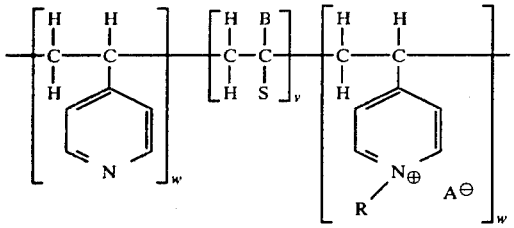

followed by transferring the developed image to a suitable substrate, and fixing the image thereto, wherein R is an alkyl radical, A is an anion, B is an alkyl radical or hydrogen, S is an acrylate, phenyl, halogen, or cyano radical, x, y, u, v, and w represent weight fraction numbers, (weight of monomer divided by total weight of polymer) subject to the provision that x+y is equal to 1, and the sum of u+v+w is equal to 1. The symbol x can thus be a number of less than 1, for example, x can be a number of from about 0.1 to about 0.9. When x is the number 0.9, y is the number 0.1. Similarly, the symbols u, v, and w can be numbers of from 0.1 to about 0.9, subject to the provision that the sum of these numbers is equal to 1.

The following examples are being supplied to further define the species of the present invention, it being noted that these examples are intended to illustrate and not limit the scope of the present invention. Parts and percentage are by weight unless otherwise indicated.

EXAMPLE I 30 grams of poly(2-vinyl pyridine) commercially available from Polyscience, Inc., was dissolved in 300 milliliters of isopropyl alcohol. There was then added to this solution 17.5 grams of isopropyl bromide, followed by heating the mixture to 60° C., with refluxing of the condensed isopropyl alcohol for 11 hours. The mixture was then cooled to room temperature and 300 milliliters of hexane was added to precipitate the resulting polymer. The material poly(2-vinyl pyridine) partially quaternized with isopropyl bromide was obtained by filtration and drying, and identified by bromine analysis.

A toner containing 6 percent Regal 330 carbon black, 2 percent of poly(2-vinyl pyridine) partially quaternized with isopropyl bromide, prepared by the above method, and 92 percent of a styrene-n-butylmethacrylate 65/35 copolymer resin, was prepared by melt blending followed by mechanical attrition. The toner was classified to remove particles below 5 microns. Three (3) parts of this toner and 100 parts of a 0.15 percent Kynar 201, a polyvinylidene flouride, commercially available from Pennwalt Corporation, coated atomized Hoeganaes steel carrier were roll mixed in a glass jar at a speed of 90 feet per minute. Tribo measurements were made at specific times using a Faraday Cage, with the following results:

| Time | Toner Tribo uc/g (Microcoulombs per gram) |
|---|---|
| 10 min. | +42 |
| 1 hour | +42 |
| 4 hours | +39 |
| 24 hours | +26 |

The above developer was utilized in a xerographic fixture, employing a negatively charged photoreceptor device, containing a vanadyl phthalocyanine photogenerating layer, and a transport layer of N-N'-diphenyl-N-N' bis(3-methylphenyl)-[1,1'-biphenyl]-4,4'-diamine dispersed in a polycarbonate resin, and prints of excellent quality and superior resolution were obtained. Also the prints had high solid area density and low background density.

EXAMPLE II 40 grams of poly(4-vinylpyridine) obtained from Polycience, Inc. was dissolved in 350 milliliters of ethyl alcohol. There was then added to the solution 50 grams of n-butyl bromide. The mixture was heated to 75° C., for 30.5 hours with refluxing of condensed solvent. After the reaction, the mixture was cooled to room temperature and 500 milliliters of hexane was added to precipitate the polymer. The poly(4-vinylpyridine) partially quaternized with n-butyl bromide was obtained by filtration and drying. Bromine analysis of the product showed that 85 percent of the pyridine unit was quaternized with n-butyl bromide.

A toner containing 6 percent Regal 330 carbon black, 2 percent poly(4-vinylpyridine) partially quaternized with n-butyl bromide prepared by the above method, and 92 percent styrene/n-butyl methacrylate (65/35) copolymer resin was prepared by melt blending followed by mechanical attrition. The toner was classified to remove particles below 5 microns. The triboelectric charge of this toner against 0.15 percent Kynar 301 (polyvinylidene fluoride commercially available from Pennwalt Corp.), coated Hoeganaes steel carrier is as follows:

| Time | Toner Tribo, uc/g (Microcoulombs per gram) |
|---|---|
| 10 min. | +36 |
| 1 hour | +26 |
| 4 hours | +20 |
| 24 hours | +14 |

EXAMPLE III

A sample of poly(4-vinylpyridine/styrene) (90/10) obtained from Polyscience Inc., was partially quaternized with n-butyl bromide using the method described in Example II. Bromine analysis of the product obtained showed that 89 percent of the pyridine unit was quaternized with n-butyl bromide.

A toner containing 6 percent Regal 330 carbon black, 2 percent poly(4-vinylpyridine/styrene) partially quaternized with n-butyl bromide, prepared by the above method, and 92 percent styrene/n-butyl methacrylate (65/35) copolymer resin was fabricated and classified to remove particles below 5 microns. Toner tribos against the carrier described in Example II were as follows:

| Time | Toner Tribo, uc/g (Microcoulombs per gram) |
|---|---|
| 10 min. | +40 |
| 1 hour | +35 |
| 4 hours | +27 |
| 24 hours | +17 |

The developer compositions of Examples II and III were utilized in the xerographic device of Example I, and substantially similar results were obtained.

Other modifications of the present invention will occur to those skilled in the art upon a reading of the present disclosure. These are intended to be included within the scope of the present invention.

What is claimed is:

1. A positively charged dry developer composition comprised of resin particles, pigment particles, carrier particles, and a charge enhancing component comprised of partially quaternized vinylpyridinium polymer or copolymer selected from the group consisting of those materials of the following formula:

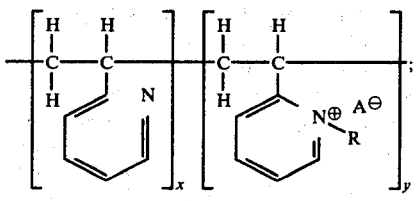

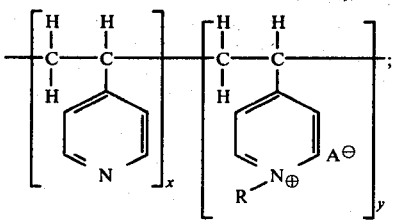

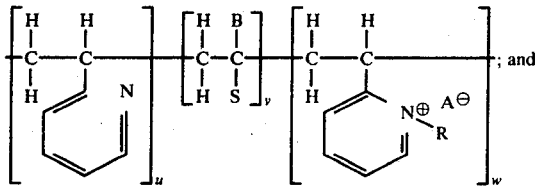

-continued

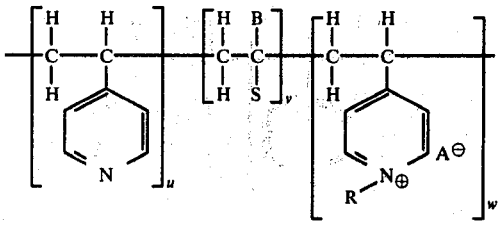

wherein R is an alkyl radical, A is an anion, B is an alkyl radical or hydrogen, S is an acrylate, phenyl, halogen, or cyano radical, x, y, u, v, w represent weight fraction numbers, subject to the provision that the sum of x and y is equal to 1, and the sum of u, v, and w is equal to 1.

2. A developer composition in accordance with claim 1 wherein R is an alkyl radical containing from 1 carbon atom, to about 6 carbon atoms, and the anion A is selected from halides, sulfate, sulfonate, borate, nitrate, or phosphate.

3. A developer composition in accordance with claim 1 wherein the resin is a styrene/n-butyl methacrylate copolymer material, the pigment is carbon black, R is methyl, S is acrylate, and A is a halogen anion.

4. A developer composition in accordance with claim 1 wherein the charge enhancing component is poly(2-vinylpyridine) partially quaternized with isopropyl bromide.

5. A developer composition in accordance with claim 1 wherein the charge enhancing component is poly(4-vinylpyridine) partially quaternized with n-butyl bromide.

6. A developer composition in accordance with claim 1 wherein the charge enhancing component is poly(4-vinylpyridine/styrene) partially quaternized with n-butyl bromide.

7. A developer composition in accordance with claim 1 wherein the partially quaternized vinyl pyridinium polymer and copolymer are present in the range of from about 0.1 percent to about 98 percent, and the pigment is present in the range of from about 2 percent to about 20 percent.

8. A developer composition in accordance with claim 1 wherein the carrier particles are comprised of a steel core coated with a vinylidene fluoride polymer or a perfluoroalkoxy fluoro polymer.

9. A method of imaging comprising forming a negative electrostatic latent image on an imaging member, contacting the image with a developer composition, comprised of resin particles, pigment particles, carrier particles, and a charge enhancing component comprised of a partially quaternized vinylpyridinium polymer or copolymer selected from the group consisting of those materials of the following formula:

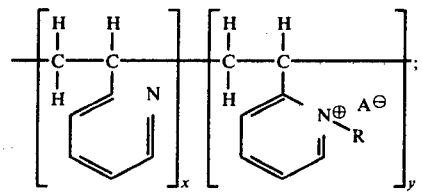

-continued

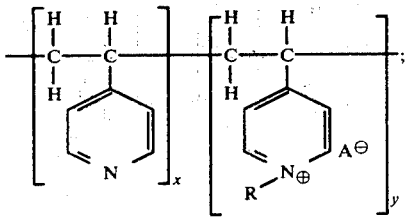

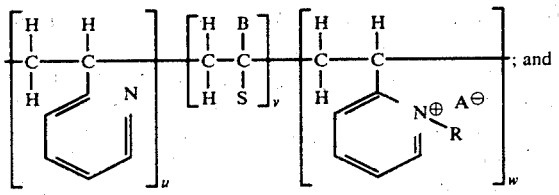

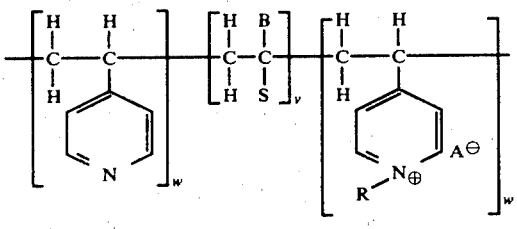

wherein R is an alkyl radical, A is an anion, B is an alkyl group or hydrogen, S is an acrylate, phenyl, halogen, or cyano radical; x, y, u, v, w represent weight fraction numbers, subject to the provision that the sum of x and y is equal to 1, and the sum of u, v, and w is equal to 1, followed by transferring the developed image to a suitable substrate, and permanently affixing said image thereto.

10. A method of imaging in accordance with claim 9 wherein R is an alkyl radical containing from 1 carbon atom, to about 6 carbon atoms, and the anion A is selected from halides, sulfate, sulfonate, borate, nitrate or phosphate.

11. A method of imaging in accordance with claim 9 wherein the resin is a styrene/n-butyl methacrylate copolymer material, the pigment is carbon black, R is methyl, S is acrylate, and A is a halogen anion.

12. A method of imaging in accordance with claim 9 wherein the quaternized material is poly(2-vinylpyridine) partially quaternized with isopropyl bromide.

13. A method of imaging in accordance with claim 9 wherein the quaternized material is poly(4-vinylpyridine) partially quaternized with n-butyl bromide.

14. A method of imaging in accordance with claim 9 wherein the quaternized material is poly(4-vinylpyridine/styrene) partially quaternized with n-butyl bromide.

15. A method of imaging in accordance with claim 9 wherein the partially quaternized vinyl pyridinium polymer and copolymer are present in the range of from about 0.1 percent to about 98 percent, and the pigment is present in the range of from about 2 percent to about 20 percent.

16. A method of imaging in accordance with claim 9 wherein the carrier particles are comprised of a steel core coated with a vinylidene fluoride polymer, or a perfluoroalkoxy fluoro polymer.

17. A positively charged dry developer composition comprised of resin particles, pigment particles, carrier particles, and as a charge enhancing component a partially quaternized vinylpyridinium polymer or copolymer selected from the group consisting of a poly(2-vinylpyridine) partially quaternized with isopropobromide, poly(4-vinylpyridine) partially quaternized with n-butylbromide, or poly (4-vinylpyridine/styrene) partially quaternized with n-butylbromide.

18. A developer composition in accordance with claim 17 wherein the resin particles are comprised of a styrene butylmethacrylate copolymer, the pigment particles are comprised of carbon black, and the carrier particles consist of a steel core coated with a vinylidene fluoride polymer or perfluoroalkoxy fluoro polymer.

19. A developer composition in accordance with claim 17 wherein the resin particles are present in an amount of 92 percent by weight, and consist of a styrene n-butylmethacrylate copolymer, containing 65 percent by weight of styrene, and 35 percent by weight of n-butylmethacrylate, the pigment particles are present in an amount of 6 percent by weight, and the charge enhancing additive is present in an amount of about 2 percent by weight.

20. A method of imaging comprising forming a negative electrostatic latent image on an imaging member, contacting the image with the developer composition of claim 17, comprised of resin particles, pigment particles, carrier particles, and as a charge enhancing component a partially quaternized vinylpyridinium polymer or copolymer selected from the group consisting of a poly(2-vinylpyridine) partially quaternized with isopropobromide, poly(4-vinylpyridine) partially quaternized with n-butylbromide, or poly(4-vinylpyridine/styrene) partially quaternized with n-butylbromide, followed by transferring the developed image to a suitable substrate and permanently affixing the image thereto.

* * * * *